US005802670A

United States Patent [19]

Bienek

[11] Patent Number: 5,802,670

[45] Date of Patent: Sep. 8, 1998

[54] DOOR CLOSER

[75] Inventor: Volker Bienek, Dortmund, Germany

[73] Assignee: Dorma GmbH +Co. KG, Ennepetal, Germany

[21] Appl. No.: 735,414

[22] Filed: Oct. 22, 1996

Related U.S. Application Data

[63] Continuation-in-part of PCT/DE96/00096 Jan. 24, 1996.

[30] Foreign Application Priority Data

Feb. 22, 1995 [DE] Germany ..... 195 06 220.5

[51] Int. Cl.[6] ..... E05F 3/10; E05F 1/08

[52] U.S. Cl. ..... 16/53; 16/62; 16/79

[58] Field of Search ..... 16/53, 60, 82, 16/DIG. 10, 52, 51, 57, 58, 59, 61, 62, 79, 71

[56] References Cited

U.S. PATENT DOCUMENTS

| | | | |
|---|---|---|---|
| 3,042,957 | 7/1962 | Muessel et al. . | |
| 3,675,270 | 7/1972 | Jentsch | 16/62 |
| 3,724,023 | 4/1973 | Tillmann | 16/53 |
| 3,838,477 | 10/1974 | Evans et al. . | |
| 4,064,589 | 12/1977 | Bejarano et al. . | |
| 4,358,870 | 11/1982 | Hong | 16/58 |
| 4,785,493 | 11/1988 | Tillmann et al. | 16/53 |
| 5,417,013 | 5/1995 | Tillmann | 16/56 |
| 5,666,692 | 9/1997 | Toledo | 16/53 |

FOREIGN PATENT DOCUMENTS

| | | | |
|---|---|---|---|
| 0491835 | 1/1977 | Australia . | |
| 1036711 | 1/1959 | Germany . | |
| 2535244 | 2/1977 | Germany . | |
| 3224300 | 12/1983 | Germany . | |
| 3638353 | 10/1987 | Germany . | |
| 4239219 | 5/1994 | Germany | 16/53 |
| 2244759 | 12/1991 | United Kingdom . | |

*Primary Examiner*—Chuck Mah
*Attorney, Agent, or Firm*—Nils H. Ljungman and Associates

[57] ABSTRACT

A door closer with an adjustable springiness has an adjusting screw located inside the pressure chamber and at the same time inside the pressure spring.

20 Claims, 3 Drawing Sheets

DOOR CLOSER

CONTINUING APPLICATION DATA

This application is a Continuation-in-Part of International Patent Application No. PCT/DE96/00096 filed on Jan. 24, 1996, which claims priority from Federal Republic of Germany Patent Application No. 195 06 220.5, filed on Feb. 22, 1995. International Patent Application No. PCT/DE96/00096 was pending as of the filing date of this application and designated the United States of America as a designated state.

BACKGROUND OF THE INVENTION

1. Field of the Invention

The present invention generally relates to a door closer which includes a drive shaft which can be connected to a door panel. The drive shaft can be rotated from a closed position in both directions of rotation and is located positively inside a housing. The drive shaft is connected to a reciprocating cam plate located between rollers. A piston connected to one of the rollers separates one pressure medium chamber from a second pressure medium chamber. Near the piston are located a hydraulic damping device, and a spring system which forms part of an energy storing device with an adjustable spring force adjustment.

2. Background Information

A similar known universal door closer is described in German Patent Publication Published for Opposition Purposes No. 25 35 244. Inside a housing there is an energy storage mechanism in the form of a compression spring. This compression spring is supported on one end on an oscillating crank and a roller connected with the oscillating crank, whereby the other end is supported against a closure in the outer wall of the housing. Inside the closure there is also a spring force adjustment mechanism which is accessible from outside. By means of the spring force adjustment mechanism, it is possible to realize a continuous adjustment of the spring force of the energy storage mechanism. If the drive shaft of the door closer is rotated by the door to which it is connected, there is a simultaneous compression of the pressure spring, on account of the cam plate which is positively and non-positively connected to the drive shaft. As a result of the compression of the pressure spring, in addition to the increased pressure of the damping medium, an additional pressure is exerted by the pressure spring on the closing cover of the housing.

An additional known door closer which has an adjustable closing force is described in German Patent No. 32 24 300. The construction of this door closer is analogous to the door closer described in German Laid Open Patent Application No. 25 35 244. Here, too, when the door is open, the entire pressure is also applied to the closing cover of the door closer housing. The spring force can be adjusted by means of an adjustment device which is accessible from the outside and is realized in the form of a screw thread.

It is also possible to adjust the spring force, before the door closer has been assembled or installed, in which case the spring force can be adjusted during assembly as a function of the size of the door closer. This situation is described in particular in the following patent literature: German Patent No. 10 36 711, U.S. Pat. No. 3,383,477, U.S. Pat. No. 4,064,589 and AU 491,835. The compression springs in this case are guided by means of a guide and force transmission element or force support element which runs through them, whereby on one end of these guide means there is an adjustment device which makes possible a continuous adjustment of the spring force. The damping piston which is also necessary for the closing process of the connected door is located next to the energy storage mechanisms described above, or in U.S. Pat. No. 4,084,589 is connected by means of a flange as an additional element outside the space in which the compression spring is located.

GB 2,244,759 A describes a door closer in which it is possible to adjust the force of the spring from outside the spring. Consequently, the outside dimensions of the door closer become larger, because the adjustment sleeve is located behind the spring of the door closer.

All of the known door closers are very large in terms of their geometric dimensions, because the damping device is not coupled or connected directly to the compression spring. On account of the types of construction selected, it is also necessary to have the housing oversized to some extent, in particular in the vicinity of the closing caps, to securely control the large forces which occur.

OBJECT OF THE INVENTION

The object of the present invention is to create a door closer, the housing of which has small geometric dimensions, but which door closer also has a very high efficiency, in which the closing force is adjustable, and simultaneously the distributions of compression to the housing walls are reduced and optimized.

SUMMARY OF THE INVENTION

The present invention teaches that this object can be accomplished if the compression spring is preferably supported inside the housing on the one hand, and the spring force adjustment preferably forms the thrust bearing or end support on the other hand. The spring force adjustment mechanism thereby can lie inside the spring in a spring adjustment sleeve which does not have a non-detachable connection, i.e. there can be only a positive or interlocking connection with the adjustment device which can be located outside the housing. The spring adjustment mechanism can be located inside the pressure chamber. When the door panel to which the door closer is connected is opened, the entire spring adjustment device can be moved along with it, i.e. as a result of the selected construction, namely the piston with the compression spring preferably inside it, the piston can be pulled. On account of the realization of the force transmission element, when the door is opened, a tensile force can be applied to the piston. Consequently, there can be essentially a straight or linear guidance of the piston, which substantially prevents a tipping of the piston, which can be placed relatively close to the drive shaft with the reciprocating cam plate preferably located on the drive shaft, adjacent to the compression spring.

As a result of this preferable arrangement, the distribution of compression, or the distribution of pressure, of the compression spring can be shifted to essentially an extremely narrow space. Namely this space is preferably located between the drive shaft and the housing support. This further results in the additional high pressures of the compression spring essentially not being exerted on the closing cap which can be necessary for the installation of the compression spring. With the adjustment device, which can be located inside the closing cap, the point of the application of the force can be preferably placed outward. It can therefore be possible, by means of the force transmission elements which can be extended through the spring, to exert a tensile load on the piston, considered in the direction from the drive shaft.

That also means that essentially no additional seals of the connecting elements are necessary between the reciprocating cam plate with its lug carriage on the one hand and the spring adjustment mechanism on the other hand. This type of arrangement substantially guarantees a very high efficiency because there can be an extremely precise guidance of the piston, and additional friction forces caused by tipping can thereby be substantially prevented.

The spring force adjustment can be realized by the creation of a device which is preferably realized in the form of an adjustment sleeve which can be located inside the space enclosed by the compression spring. This adjustment sleeve can have a cavity, in the base of which there can be a connection between the force transmission elements, namely the lug carriage, and the connecting element. The spring force can be substantially simultaneously adjusted by means of this connection, whereby on one hand the adjustment can be made on the assembly at some point before it is installed in the door closer, or after it has been installed, because inside the spring adjustment sleeve there can be a cavity in which an adjustment device which is preferably mounted in the closing cap can be inserted. The complete insertion of the adjustment device in the spring adjustment sleeve, i.e. in the spring cavity, can result in substantially an enormous reduction in the overall length of the door closer.

The transmission of force between the driver of the adjustment device and the adjustment sleeve can be achieved by a positive or interlocking or splined connection. This positive connection can have the shape of a hexagon or some other geometric shape, whereby in a particular embodiment the shape of the driver is formed so that it corresponds to the opening of the adjustment sleeve. That shows that there preferably is not a non-detachable connection between the adjustment mechanism which is accessible from the outside and the spring force adjustment mechanism which is located inside the pressure chamber. At essentially the same time, however, the spring force can be changed from the outside by actuating the adjustment device, without thereby substantially adversely affecting the operation of the door closer.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to one possible embodiment which is illustrated schematically in the accompanying drawings, wherein.

DESCRIPTION OF THE PREFERRED EMBODIMENT

Figure 1:
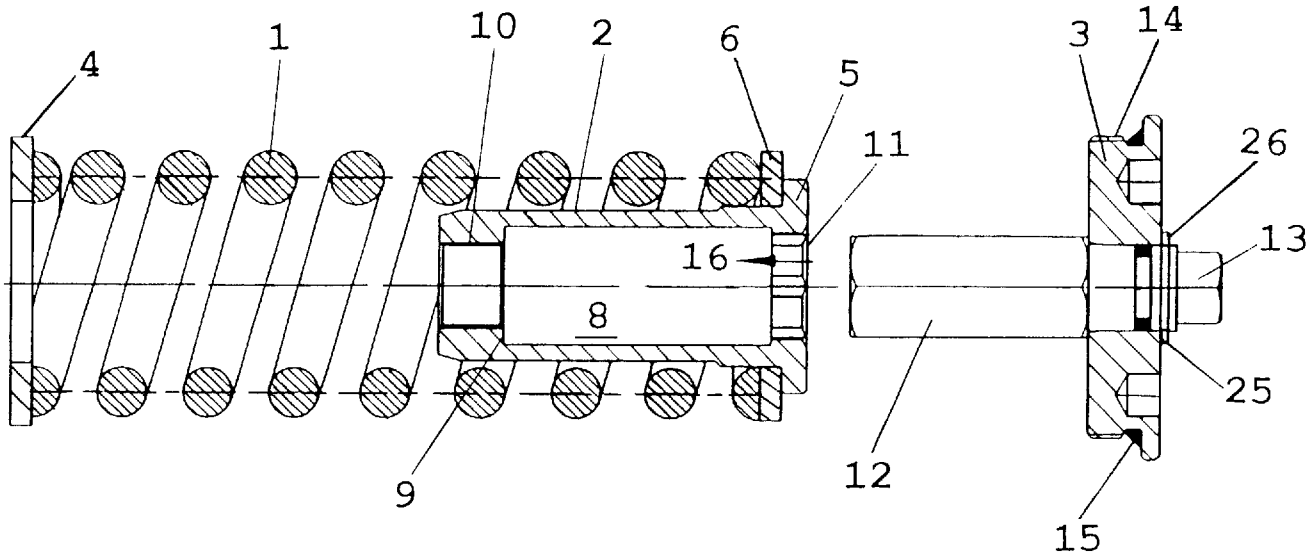
FIG. 1 shows individual parts of the spring force adjustment mechanism.
Figure 2:
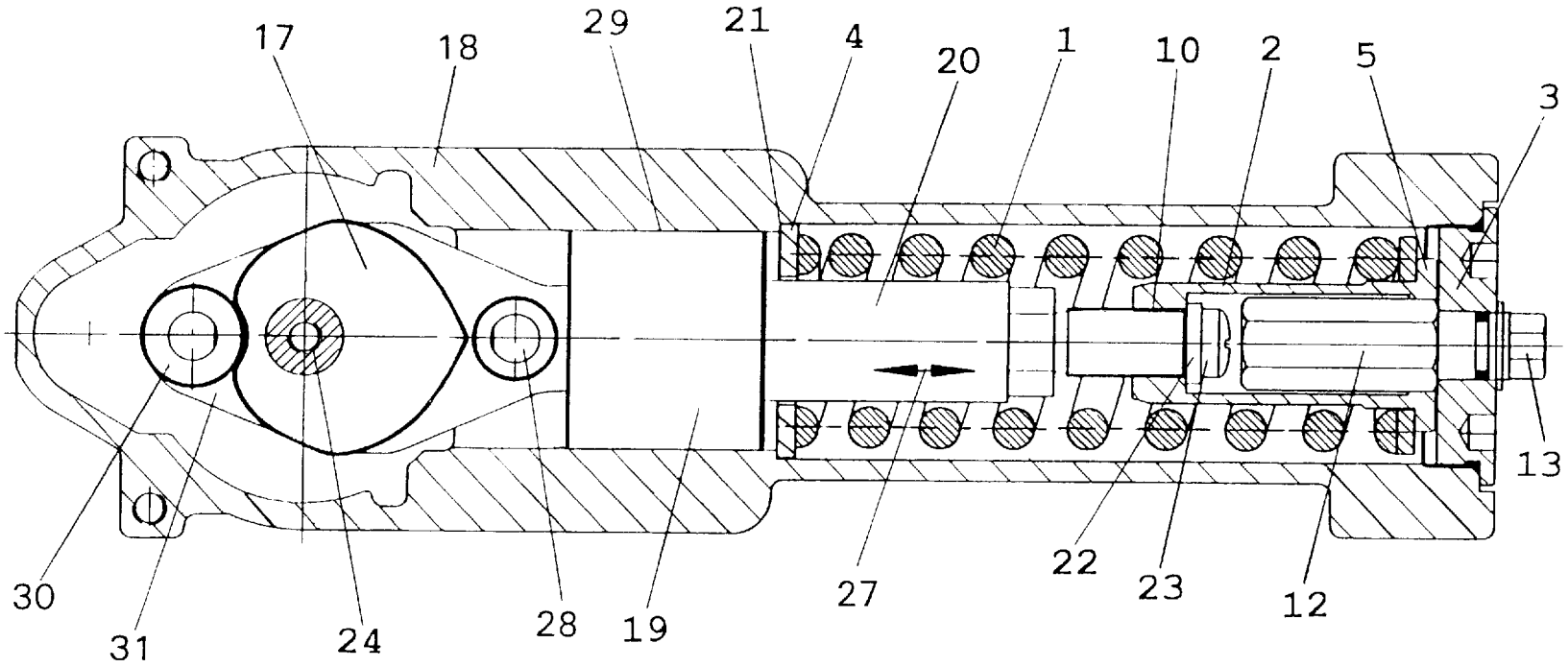
FIG. 2 shows a cross section of the door closer with the compression spring not compressed.

FIG. 2 is a sectional drawing, in a view from above, of a door closer and essentially showing a system of a compression spring 1, a piston 19 and a reciprocating cam plate 17 in a housing 18. The reciprocating cam plate 17 can be positively and non-positively located on a drive shaft 24 of the door closer, whereby the reciprocating cam plate 17 is preferably guided by a pressure roller 30 and a support roller 28 which can be fastened in a lug carriage 31. Simultaneously, a damping device or piston 19 can also be fastened to the lug carriage 31. Adjacent to the piston 19 there can be a connecting element 20 which can locate an adjustment screw 23. This connecting element 20 is inserted in the interior of the compression spring 1. and can have thereby a substantial portion of the connecting element 20 completely surrounded by the compression spring 1. The compression spring 1 can be placed inside the housing 18 so that the compression spring 1 can be supported approximately in the middle of the housing 18 on a projection 21, with an intermediate supporting ring or retaining washer 4 on one end of the compression spring 1. The other free end of the compression spring 1 can be directed towards a supporting ring 6 (shown in FIG. 1). Extending through the supporting ring 6 can be an adjustment sleeve 2, which can also extend into the interior of the compression spring 1. The adjustment sleeve 2 can be designed so that it has a projecting collar 5 which is supported on the supporting ring 6.

As shown in FIG. 1, the adjustment sleeve 2 can also be realized so that there is a cavity 8 in the interior portion of the adjustment sleeve 2. In the vicinity of the collar 5 there can be an opening 11 which makes possible a geometric shape which can correspond to the shape of a driver 12 for a positive or interlocking connection between the driver 12 and the adjustment sleeve 2. The driver 12, as a function of a direction of movement 16, can extend through the opening 11 into the cavity 8 of the adjustment sleeve 2. Simultaneously, however, the driver 12 can also be surrounded by the compression spring 1, so that the driver 12 can be located in the interior of the compression spring 1. That means that there is essentially no enlargement of the door closer as a result of the adjustment mechanism. The opening 11 can be somewhat smaller in terms of its geometric dimensions, so that the driver 12 can be in a positive connection with the adjustment sleeve 2 practically and essentially only in the vicinity of the opening 11.

Figure 3:
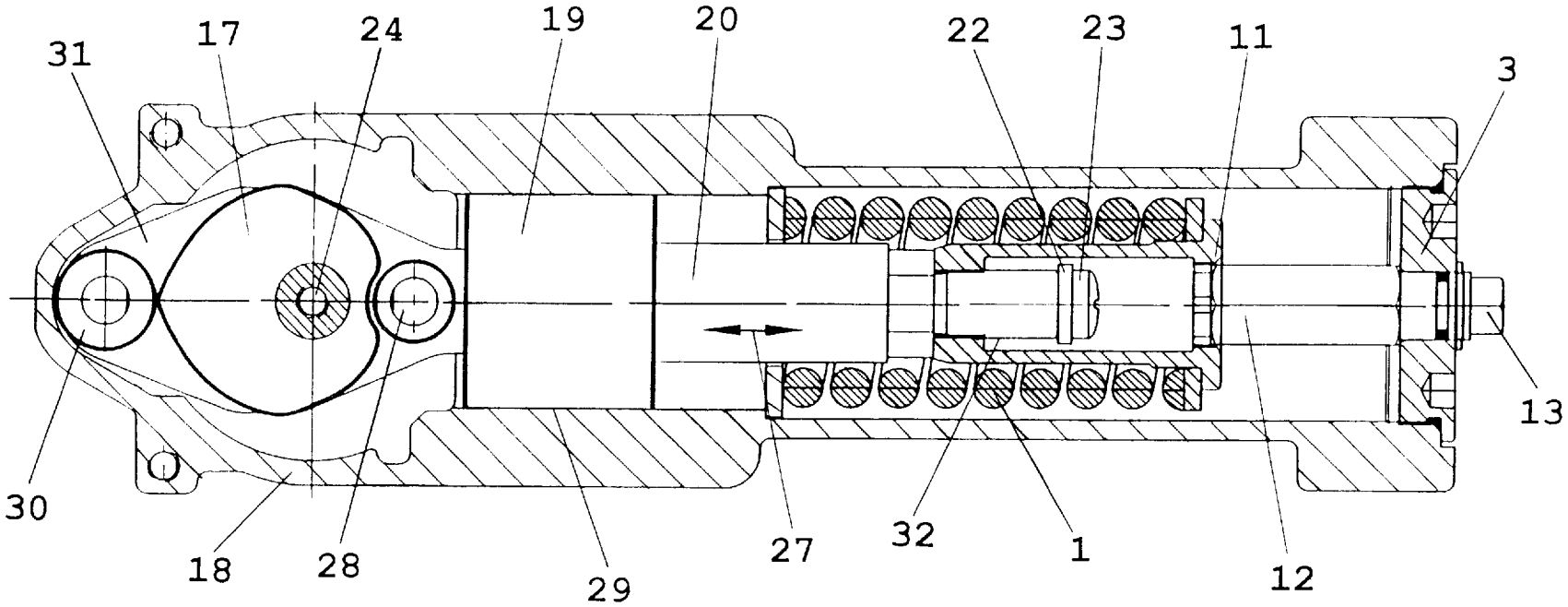
FIG. 3 shows a door closer in cross section with the compression spring compressed.

As shown in FIG. 2, in a base or bottom 9 (shown in FIG. 1) of the adjustment sleeve 2 there can be a screw thread 10 (shown in FIG. 1), which effects the spring force adjustment in connection with an adjustment screw 23 as a result of the actuation of the screw thread 10. The adjustment screw 23 can thereby preferably be positively and non-positively engaged with the connecting element 20. A thrust bearing and thus a stop for the unintentional unscrewing of the adjustment screw 23 can be formed by a lock washer 22. In the relaxed state of the spring force adjustment, this lock washer 22 can be in contact against the base or bottom 9 of the adjustment sleeve 2. FIG. 3 illustrates how a spring adjustment travel 32 can be used to adjust the compression spring 1 and thus to perform the corresponding force adjustment. In the embodiment illustrated, substantially the maximum possible spring adjustment travel 32 has been utilized.

The reciprocating cam plate 17 can be rotated as a result of the actuation of the drive shaft 24 with the door connected to it (not shown). At the same time, the piston 19 inside a cylinder wall 29 can also execute its stroke inside an actuator stroke or distance 27.

Examples of cam assemblies used in door closing apparatus can be found in the following U.S. Pat. Nos. 4,376,323, 4,658,468, 4,785,493 and 5,417,013, each of which U.S. Patents are hereby incorporated by reference as if fully set forth herein.

A further example of a cam assembly used in a door closing apparatus can be found in the following U.S. Patent Application, assigned to the assignee of the present application and hereby incorporated by reference as if fully set forth herein: Ser. No. 08/735/970, filed Oct. 23, 1996 and having inventor Volker Bienek, titled "Automatic Door Closer and Process for Assembly of Same" and having Attorney Docket reference NHL-DOR-30, said U.S. Patent Application being a Continuation-in-Part of International Patent Application No. PCT/DE96/00095 filed on Jan. 24, 1996, which claims priority from Federal Republic of Germany Patent Application No. 195 06 355.4, filed on Feb. 23, 1995 and corresponding to DE-OS 195 06 355.4 and DE-PS 195 06 355.4.

As shown in FIG. 1, to change the spring force adjustment even after the door closer has been assembled and/or installed, the driver 12 is preferably placed inside a closing cap 3 by means of a gasket 25, and can be secured by means of a lock washer 26. The end of the driver 12 which projects out of the closing cap 3, namely an adjustment screw 13, can be accessible with a corresponding tool (not shown). The closing cap 3 can be screwed into the housing 18 by means of a screw thread 14. A seal can be created by a gasket 15. When the closing cap 3 is installed, the projecting driver 12 can essentially be simultaneously introduced into the adjustment sleeve 2 through the opening 11 so that there are essentially no enlargements which extend beyond the cross section of the driver 12. The driver 12 can essentially be completely installed inside the adjustment sleeve 2. In the embodiment shown, the driver 12 can be realized in the form of a hexagon, which means that the same hexagonal shape can also be present in the opening 11. It is also conceivable, however, that any other shape which is capable of transmitting the corresponding forces for the adjustment of the compression spring 1 when the adjustment screw 13 is actuated can be used in this location.

In the embodiment illustrated in FIG. 2, the compression spring 1 is shown in the decompressed state. Simultaneously the FIG. 1 illustrates that the driver 12 can essentially be completely inserted inside the adjustment sleeve 2 into the cavity 8, in contrast to known similar devices, in which the drivers are located behind the adjustment device and thus result in an elongation of the door closer. In contrast, FIG. 3 shows that the compression spring 1 can be adjusted to essentially a maximum spring bias, and simultaneously the door can be rotated by 180 degrees, which preferably results in a maximum compression of the compression spring 1. In this extreme position, it must still be essentially guaranteed that the driver 12 can remain inside the opening 11 of the adjustment sleeve 2. As a result of this type of device, it becomes clear that there preferably is not a non-detachable connection between the spring adjustment mechanism and the connecting element 20. The entire adjustment screw 23 is preferably also moved when the drive shaft 24 is actuated, i.e. the adjustment screw 23 is pulled, which simultaneously represents better guidance for the piston 19.

In other words, the length of the compression spring 1 can, for an embodiment of the present invention, be adjusted to vary the axial force applied by the compression spring 1 against the piston 19. By rotating the adjustment screw 13 for an adjustment, the driver 12 is rotated. The driver 12 can be connected to the adjustment sleeve 2 by way of a preferably splined or other non-rotational connection at the opening 11. Rotating the driver 12 thereby rotates the adjusting sleeve 2 about the adjustment screw 23. Because the adjustment sleeve 2 is preferably threadingly engaged with the adjustment screw 23 by screw thread 10, rotation of the axial sleeve 2 axially displaces the adjustment sleeve 2 to change the distance between the washer 4 and the flange 5, thereby adjusting the length of the compression spring 1.

Because the adjusting sleeve 2, the adjustment screw 23, the driver 12 and the connecting element 20 can be located inside of the compression spring 1, the housing 18 need only accommodate the outer diameter of the compression spring 1, and does not need to be made a larger diameter to accommodate a spring adjustment device. Further, the adjusting sleeve 2 can be displaced axially with respect to the driver 12, and can be fixed axially with relationship to the adjustment screw during an axial displacement by means of screw thread 10. This improves the guiding of the piston 19 and acts to prevent tipping of the piston 19 by means of restoring forces or moments generated at the screw thread 10 and the driver 12.

As a result of this type of construction of the embodiment shown, essentially no additional compression forces are exerted on the closing cap 3, as is the case in known similar devices. Essentially, the entire distribution of compression can be directed to a very narrow space, namely toward approximately the middle of the housing. As a result of this type of construction it can be possible to keep the geometric dimensions of the housing within very narrow limits. Nor essentially is any sealing necessary, beyond the seals which are required in any case for the piston rod, because in the system claimed by the present invention, all the equipment of the spring adjustment mechanism is located inside the pressure chamber. As a result of this measure, the efficiency of such a door closer can be significantly higher than known door closers.

Additional advantages of the present invention include the significantly shorter overall length of the door closer with simultaneously small dimensions of the housing. An adjustment of the spring force can be performed easily, whereby at the same time it can also be essentially guaranteed that the piston will not twist or tip, which would adversely affect the desired efficiency.

One feature of the present invention resides broadly in the door closer with a drive shaft 24 which can be connected to a door panel, which drive shaft 24 can be rotated from a closed position in both directions of rotation and is located positively inside a housing 18 with a reciprocating cam plate 17 between rollers 28, 30, a piston 19 which separates pressure medium chambers from one another, which piston 19 is placed near the support roller 28 and the reciprocating cam plate, a hydraulic damping device and a spring system which forms an energy storage mechanism with an adjustable spring force adjustment, whereby the compression spring 1 of the energy storage mechanism is supported toward the middle of the door closer housing 18 on a projection 21 on one end, and on the other end against an adjustment sleeve 2 which extends substantially completely into the interior of the compression spring 1, whereby the adjustment sleeve 2 is adjustably connected to the piston 19 by means of a connecting element 20, and there is a cavity 8 in the interior of the adjustment sleeve 2.

Another feature of the present invention resides broadly in the door closer characterized by the fact that the adjustment sleeve 2 has a collar 5, against which the compression spring 1 is supported.

Yet another feature of the present invention resides broadly in the door closer characterized by the fact that an adjustment screw 23 in a base 9 of the adjustment sleeve 2 can be engaged with the adjustment sleeve 2 by means of a screw thread 10.

Still another feature of the present invention resides broadly in the door closer characterized by the fact that when the door closer is assembled, the spring force adjustment is made by means of an adjustment screw 13 with a driver 12 connected to it, which driver 12 is positively inserted into the adjustment sleeve 2, whereby the connecting element 20 with the adjustment sleeve 2 can simultaneously be displaced in relation to the driver 12 in the directions of motion 27.

A further feature of the present invention resides broadly in the door closer characterized by the fact that the driver 12 has a polygonal shape, which shape is also present in the opening 11 of the adjustment sleeve 2.

Examples of door closer assemblies which could be used or which could possibly be adapted for use in the context of the present invention might be disclosed by the following U.S. Patents, all of which have been assigned to the assignee of the present application: No. 5,311,642, No. 5,461,754, No. 5,417,013 and No. 5,544,462.

Further examples of door closer assemblies which could be used or which could possibly be adapted for use in the context of the present invention might be disclosed by the following U.S. Patent Applications, all of which have been assigned to the assignee of the present application: Ser. No. 08/695,791 and Ser. No. 08/597,131.

Yet another example of a door closer assembly which could be used or which could possibly be adapted for use in the context of the present invention might be disclosed by the following U.S. Patent Application, which has been assigned to the assignee of the present application: Ser. No. 08/733,226, filed Oct. 17, 1996, titled "Hydraulic Servo Door Closer" and having inventors Peter Krumhauer and Thomas Salutzki and having Attorney Docket reference NHL-DOR-29, and claiming priority from Federal Republic of Germany Patent Application No. 195 38 482.2 filed Oct. 17, 1995.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 195 06 220.5, filed on Feb. 22, 1995, and PCT/DE96/00096, filed on Jan. 24, 1996, having inventor Volker Bienek, and DE-OS 195 06 220.5 and DE-PS 195 06 220.5 and International Application No. PCT/DE96/00096, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A door closer comprising:

a housing having a longitudinal axis;

said housing having a first end and an axially opposite second end;

said housing comprising a chamber disposed within said housing;

a piston being disposed within said housing chamber;

an arrangement to connect said piston to a door;

said piston being movable within said housing chamber in a direction substantially parallel to the longitudinal axis in response to an opening and closing of a door;

said housing comprising a projection;

said projection being disposed to divide said housing chamber into first and second chamber portions;

said first chamber portion being disposed between said first end of said housing and said projection;

said second chamber portion being disposed between said projection and said second end of said housing;

an adjustment sleeve being adjustably connected to said piston to move with said piston;

said adjustment sleeve being disposed within said second chamber portion;

said adjustment sleeve being spaced from said piston a distance substantially parallel to the longitudinal axis;

a spring to store energy during an opening of a door for subsequently closing a door;

said spring being disposed between said housing projection and said adjustment sleeve to transfer a force between said housing and said adjustment sleeve;

a connection member being disposed between said piston and said adjustment sleeve to transfer a force between said piston and said adjustment sleeve;

said connection member having a longitudinal axis;

said connection member comprising a first end portion and a second end portion;

said first end portion of said connection member being attached to said piston;

said second end portion of said connection member being adjustably connected to said adjustment sleeve;

said adjustment sleeve having a longitudinal axis;

said adjustment sleeve comprising a first end portion and an axially opposite second end portion;

said spring being disposed about both of said first and second end portions of said adjustment sleeve;

said first end portion of said adjustment sleeve being adjustable connected to said second end portion of said connection member;

said first end portion of said adjustment sleeve comprising a connecting arrangement;

said connecting arrangement being configured to permit said first end portion of said adjustment sleeve to be adjustably connected to said second end portion of said connection member at different positions with respect to said second end portion of said connection member;

said connecting arrangement being configured to permit adjustment of the distance between said adjustment sleeve and said piston to vary the force transferred by said spring;

an apparatus to adjust said connecting arrangement of said adjustment sleeve;

said adjusting apparatus being configured to adjust the position of said first end portion of said adjustment sleeve with respect to said second end portion of said connection member to adjust where said first end portion of said adjustment sleeve is connected to said second end portion of said connection member; and said second end portion of said adjustment sleeve comprising a hollow portion.

2. The door closer according to claim 1, wherein said connecting arrangement comprises the sole adjustment of the position of said first end portion of said adjustment sleeve with respect to said second end portion of said connection member and thus, the sole adjustment of the distance between said adjustment sleeve and said piston to vary the force transferred by said spring.

3. The door closer according to claim 2, wherein:

said adjustment sleeve and said connection member are disposed substantially coaxially with respect to one another;

said connecting arrangement comprises a first threaded portion;

said first threaded portion extends along the longitudinal axis of said adjustment sleeve;

said second end portion of said connection member comprises a second threaded portion;

said second threaded portion extends along the longitudinal axis of said connection member; and one of said first and second threaded portions is threadingly engaged about the other of said first and second threaded portions to permit varying the distance between said adjustment sleeve and said piston.

4. The door closer according to claim 3, wherein:

said second end portion of said adjustment sleeve further comprises a ring-shaped portion;

said ring-shaped portion is disposed between the remainder of said second end portion of said adjustment sleeve and said second end of said housing;

said ring-shaped portion is disposed substantially concentrically about the longitudinal axis of said adjustment sleeve;

said spring abuts said ring-shaped portion to transfer a force directed substantially parallel to the longitudinal axis between said spring and said ring-shaped portion;

said ring-shaped portion of said second end portion of said adjustment sleeve comprises an internal bore;

said ring-shaped portion and said hollow portion of said second end portion of said adjustment sleeve are disposed substantially coaxially adjacent one another;

said internal bore of said ring-shaped portion and said hollow portion are disposed to form a passageway within said second end portion of said adjustment sleeve;

said passageway is open to said second end of said housing; and said passageway comprises a connection portion configured to form a non-rotatable connection with a driver insertable into said connection portion of said passageway from the direction of said second end of said housing.

5. The door closer according to claim 4, wherein:

said adjusting apparatus comprises a driver having a longitudinal axis;

said driver extends through said second end of said housing to divide said driver into a first end portion and an axially opposite second end portion;

said driver is disposed substantially coaxially with said adjustment sleeve;

said driver is rotatable about its longitudinal axis;

said first end portion of said driver is disposed within said second chamber portion of said housing;

said second end portion of said driver is configured to receive torque to selectively rotate said driver about its longitudinal axis;

said first end portion of said driver extends into said connection portion of said passageway of said second end portion of said adjustment sleeve to non-rotatably connect said driver and said second end portion of said adjustment sleeve; and both said driver and said connection portion are configured to guide movement of said second end portion of said adjustment sleeve along said driver in a direction substantially parallel to the longitudinal axis of said driver.

6. The door closer according to claim 5, wherein:

said internal bore of said ring-shaped portion of said second end portion of said adjustment sleeve comprises said connection portion of said passageway;

said first end portion of said driver extends through said internal bore of said ring-shaped portion of said second end portion of said adjustment sleeve;

said first end portion of said driver extends into said hollow portion of said second end portion of said adjustment sleeve;

said first end portion of said driver has a first cross-section oriented substantially transverse to the longitudinal axis of said driver;

said first cross-section of said first end portion of said driver has substantially a shape of a polygon;

said internal bore of said ring-shaped portion of said second end portion of said adjustment sleeve has a second cross-section oriented substantially transverse to the longitudinal axis of said adjustment sleeve; and said second cross-section of said internal bore comprises substantially a shape of a polygon.

7. The door closer according to claim 6, wherein:

said piston is disposed within said first chamber portion of said housing;

said arrangement to connect said piston to a door comprises a cam device to convert between rotary motion and axial motion during an opening and closing of a door;

said cam device is disposed between said first end of said housing and said piston;

said cam device comprises a drive shaft having an axis of rotation;

said drive shaft is at least partially disposed within said housing chamber;

said drive shaft is configured and disposed to be attached to a door panel of a door;

said drive shaft is rotatable about the axis of rotation in a first direction of rotation and an opposite second direction of rotation;

said cam device comprises a cam plate disposed within said housing chamber;

said cam plate is connected to said drive shaft to rotate with said drive shaft about the axis of rotation;

said cam device comprises a first roller and a second roller to convert rotary motion of said cam plate to axial translation of said first and second rollers in a direction substantially parallel to the longitudinal axis of said housing;

said first and second cam rollers are disposed within said housing chamber;

said cam plate is disposed between said first and second rollers;

said first roller is disposed between said cam plate and said piston;

said first and second rollers are operatively connected to said piston to move said piston;

said piston divides said housing chamber into first and second chamber regions;

each of said first and second chamber regions contains a damping fluid to dampen motion of said piston;

said first threaded portion of said connecting arrangement is disposed about said second threaded portion of said second end portion of said connection member; and said second threaded portion comprises a screw.

8. The door closer according to claim 2, wherein:

said second end portion of said adjustment sleeve further comprises a ring-shaped portion;

said ring-shaped portion is disposed between the remainder of said second end portion of said adjustment sleeve and said second end of said housing;

said ring-shaped portion is disposed substantially concentrically about the longitudinal axis of said adjustment sleeve;

said spring abuts said ring-shaped portion to transfer a force directed substantially parallel to the longitudinal axis between said spring and said ring-shaped portion;

said ring-shaped portion of said second end portion of said adjustment sleeve comprises an internal bore;

said ring-shaped portion and said hollow portion of said second end portion of said adjustment sleeve are disposed substantially coaxially adjacent one another;

said internal bore of said ring-shaped portion and said hollow portion are disposed to form a passageway within said second end portion of said adjustment sleeve;

said passageway is open to said second end of said housing; and said passageway comprises a connection portion configured to form a non-rotatable connection with a shaft insertable into said connection portion from the direction of said second end of said housing.

9. The door closer according to claim 8, wherein:

said adjusting apparatus comprises a shaft having a longitudinal axis;

said shaft extends through said second end of said housing to divide said shaft into a first shaft portion and a second shaft portion;

said shaft is disposed substantially coaxially with said adjustment sleeve;

said shaft is rotatable about its longitudinal axis;

said first shaft portion is disposed within said second chamber portion of said housing;

said second shaft portion is disposed outside of said housing;

said second shaft portion is configured to receive torque to selectively rotate said shaft about its longitudinal axis;

said first shaft portion extends into said connection portion of said passageway of said second end portion of said adjustment sleeve to non-rotatably connect said shaft and said second end portion of said adjustment sleeve; and both said first shaft portion and said connection portion of said passageway are configured to guide movement of said second end portion of said adjustment sleeve along said first shaft portion in a direction substantially parallel to the longitudinal axis of said shaft.

10. The door closer according to claim 9, wherein:

said internal bore of said ring-shaped portion comprises said connection portion of said passageway;

said first shaft portion extends through said internal bore of said ring-shaped portion of said second end portion of said adjustment sleeve;

said first shaft portion extends into said hollow portion of said second end portion of said adjustment sleeve;

said first shaft portion has a first cross-section oriented substantially transverse to the longitudinal axis of said shaft;

said first cross-section of said first shaft portion has substantially a polygon shape;

said internal bore of said ring-shaped portion of said second end portion of said adjustment sleeve has a second cross-section oriented substantially transverse to the longitudinal axis of said adjustment sleeve;

said second cross-section of said internal bore of said ring-shaped portion has substantially a polygon shape;

said piston is disposed within said first chamber portion of said housing;

said arrangement to connect said piston to a door comprises a cam arrangement to convert between rotary motion and axial motion during an opening and closing of a door;

said cam arrangement is disposed between said first end of said housing and said piston;

said cam arrangement comprises a drive shaft having an axis of rotation;

said drive shaft is at least partially disposed within said housing chamber;

said drive shaft is configured and disposed to be attached to a door panel of a door;

said drive shaft is rotatable about the axis of rotation in a first direction of rotation and an opposite second direction of rotation;

said cam arrangement comprises a cam disposed within said housing chamber;

said cam is connected to said drive shaft to rotate with said drive shaft about the axis of rotation;

said cam arrangement comprises at least one roller contacting said cam;

said at least one roller is disposed to convert rotary motion of said cam plate to axial translation of said at least one roller in a direction substantially parallel to the longitudinal axis of said housing;

said at least one roller is disposed within said housing chamber;

said at least one roller is disposed between said cam plate and said piston;

said at least one roller is operatively connected to said piston to move said piston;

said piston divides said housing chamber into first and second chamber regions;

each of said first and second chamber regions contain a damping fluid to dampen motion of said piston;

said second end portion of said connection member comprises a screw;

said screw comprises a threaded portion extending substantially parallel to the longitudinal axis of said connection member;

said connecting arrangement comprises a threaded portion; and said threaded portion of said connecting arrangement being threadingly disposed about said threaded portion of said screw.

11. The door closer according to claim 1, wherein:

said second end portion of said connection member comprises a screw;

said screw comprises a threaded portion extending substantially parallel to the longitudinal axis of said connection member;

said connecting arrangement comprises a threaded portion;

said threaded portion of said connecting arrangement is threadingly disposed about said threaded portion of said screw; and said screw extends into said hollow portion of said second end portion of said adjustment sleeve.

12. The door closer according to claim 11, wherein:

said hollow portion of said second end portion of said adjustment sleeve is open to said second end of said housing;

said hollow portion of said second end portion of said adjustment sleeve further comprises a connection portion; and said connection portion of said hollow portion is configured to form a non-rotatable connection with a driver insertable into said connection portion from the direction of said second end of said housing.

13. The door closer according to claim 12, wherein:

said adjusting apparatus comprises a driver having a longitudinal axis;

said driver extends through said second end of said housing to divide said driver into a first end portion and an axially opposite second end portion;

said driver is disposed substantially coaxially with said adjustment sleeve;

said driver is rotatable about its longitudinal axis;

said first end portion of said driver is disposed within said second chamber portion of said housing;

said second end portion of said driver is configured to receive torque to selectively rotate said driver about its longitudinal axis;

said first end portion of said driver extends into said connection portion of said hollow portion of said second end portion of said adjustment sleeve to non-rotatably connect said driver and said second end portion of said adjustment sleeve; and both said driver and said connection portion of said hollow portion are configured to guide movement of said second end portion of said adjustment sleeve along said first end portion of said driver in a direction substantially parallel to the longitudinal axis of said driver.

14. The door closer according to claim 13, wherein:

said hollow portion of said second end portion of said adjustment sleeve further comprises an additional portion;

said additional portion is disposed between the remainder of said second end portion and said second end of said housing;

said additional portion comprises an internal bore extending about the longitudinal axis of said adjustment sleeve;

said internal bore of said additional portion comprises said connection portion of said hollow portion of said second end portion of said adjustment sleeve;

said first end portion of said driver extends through said internal bore of said additional portion of said hollow portion of said second end portion of said adjustment sleeve into the remainder of said hollow portion of said second end portion of said adjustment sleeve;

said first end portion of said driver has a first cross-section oriented substantially transverse to the longitudinal axis of said driver;

said first cross-section of said first end portion of said driver has a shape substantially of a polygon;

said internal bore of said additional portion has a second cross-section oriented substantially transverse to the longitudinal axis of said adjustment sleeve;

said second cross-section of said internal bore of said additional portion has substantially a shape of a polygon;

said additional portion of said hollow portion of said second end portion of said adjustment sleeve comprises a ring-shaped portion being disposed substantially concentrically about the longitudinal axis of said adjustment sleeve;

said ring-shaped portion comprises an outer portion being disposed radially from the longitudinal axis of said adjustment sleeve a greater distance than the remainder of said adjustment sleeve;

said spring comprises a first end and an axially opposite second end;

said second end of said spring is disposed against said ring-shaped portion to transfer a force directed substantially parallel to the longitudinal axis of said adjustment sleeve between said second end of said spring and said ring-shaped portion;

said piston is disposed within said first chamber portion of said housing;

said arrangement to connect said piston to a door comprises a cam arrangement to convert between rotary motion and axial motion during an opening and closing of a door;

said cam arrangement is disposed between said first end of said housing and said piston;

said cam arrangement comprises a drive shaft having an axis of rotation;

said drive shaft is at least partially disposed within said first chamber portion;

said drive shaft is configured and disposed to be attached to a door panel of a door;

said drive shaft is rotatable about the axis of rotation in a first direction of rotation and an opposite second direction of rotation;

said cam arrangement comprises a cam being disposed within said first chamber portion;

said cam is connected to said drive shaft to rotate with said drive shaft about the axis of rotation;

said cam arrangement comprises at least one roller contacting said cam;

said at least one roller is disposed to convert rotary motion of said cam to translation of said at least one roller axially;

said at least one roller is disposed within said first chamber portion of said housing;

said at least one roller is disposed between said cam and said piston;

said at least one roller is operatively connected to said piston to move said piston;

said piston divides said housing chamber into first and second chamber regions; and each of said first and second chamber regions contains a damping fluid to dampen movement of said piston.

15. The door closer according to claim 1, wherein:

said hollow portion of said second end portion of said adjustment sleeve is open to said second end of said housing;

said hollow portion of said second end portion of said adjustment sleeve further comprises a connection portion; and said connection portion of said hollow portion is configured to form a non-rotatable connection with a shaft insertable into said connection portion from the direction of said second end of said housing.

16. The door closer according to claim 15, wherein:

said first end portion of said adjustment sleeve is rotatably connected to said second end portion of said connection member to permit adjustment of the distance between said adjustment sleeve and said piston;

said connection portion of said hollow portion of said second end portion of said adjustment sleeve comprises said second end of said adjustment sleeve;

said adjusting apparatus comprises a shaft having a longitudinal axis;

said shaft extends through said second end of said housing to divide said shaft into a first shaft portion and a second shaft portion;

said shaft is disposed substantially coaxially with said adjustment sleeve;

said shaft is rotatable about its longitudinal axis;

said first shaft portion is disposed within said second chamber portion of said housing;

said second shaft portion is disposed outside of said housing;

said second shaft portion is configured to receive torque to selectively rotate said shaft about its longitudinal axis;

said first shaft portion extends through said connection portion into the remainder of said hollow portion of said second end portion of said adjustment sleeve to non-rotatably connect said shaft and said adjustment sleeve; and said first shaft portion is configured to guide movement of said connection portion along said first shaft portion.

17. The door closer according to claim 16, wherein:

said second end portion of said connection member comprises a first threaded portion;

said first threaded portion extends along the longitudinal axis of said connection member;

said connecting arrangement comprises a second threaded portion threadingly disposed about said first threaded portion of said connection member; and said first threaded portion extends partially into said hollow portion of said second end portion of said adjustment sleeve.

18. The door closer according to claim 17, wherein:

said hollow portion of said second end portion of said adjustment sleeve further comprises an additional portion;

said additional portion is disposed between the remainder of said second end portion and said second end of said housing;

said additional portion comprises an internal bore extending about the longitudinal axis of said adjustment sleeve;

said internal bore of said additional portion comprises said connection portion of said hollow portion of said second end portion of said adjustment sleeve;

said first end portion of said driver extends through said internal bore of said additional portion into the remainder of said hollow portion of said second end portion of said adjustment sleeve;

said first end portion of said driver has a first cross-section oriented substantially transverse to the longitudinal axis of said driver;

said first cross-section of said first end portion of said driver has a shape substantially of a polygon;

said internal bore of said additional portion has a second cross-section oriented substantially transverse to the longitudinal axis of said adjustment sleeve; and said second cross-section of said internal bore of said additional portion has substantially a shape of a polygon.

19. The door closer according to claim 18, wherein:

said additional portion of said hollow portion of said second end portion of said adjustment sleeve comprises a ring-shaped portion disposed substantially concentrically about the longitudinal axis of said adjustment sleeve;

said ring-shaped portion comprises an outer portion disposed radially from the longitudinal axis of said adjustment sleeve a greater distance than the remainder of said adjustment sleeve;

said spring comprises a first end and an axially opposite second end; and said second end of said spring is supported against said ring-shaped portion to transfer a force directed substantially parallel to the longitudinal axis of said adjustment sleeve between said second end of said spring and said ring-shaped portion.

20. The door closer according to claim 19, wherein:

said piston is disposed within said first chamber portion of said housing;

said arrangement to connect said piston to a door comprises a cam device to convert between rotary motion and axial motion during an opening and closing of a door;

said cam device is disposed between said first end of said housing and said piston;

said cam device comprises a drive shaft having an axis of rotation;

said drive shaft is at least partially disposed within said housing chamber;

said drive shaft is configured and disposed to be attached to a door panel of a door;

said drive shaft is rotatable about the axis of rotation in a first direction of rotation and an opposite second direction of rotation;

said cam device comprises a cam plate disposed within said housing chamber;

said cam plate is connected to said drive shaft to rotate with said drive shaft about the axis of rotation;

said cam device comprises a first roller and a second roller to convert rotary motion of said cam plate to axial translation of said first and second rollers in a direction substantially parallel to the longitudinal axis of said housing;

said first and second cam rollers are disposed within said housing chamber;

said cam plate is disposed between said first and second rollers;

said first roller is disposed between said cam plate and said piston;

said first and second rollers are operatively connected to said piston to move said piston;

said piston divides said housing chamber into first and second chamber regions;

each of said first and second chamber regions contains a damping fluid to dampen motion of said piston;

said second end portion of said connection member comprises a screw portion;

said screw portion comprises said first threaded portion;

said second threaded portion of said connecting arrangement is threadingly disposed about said first threaded portion of said screw; and said screw portion extends into said hollow portion of said second end portion of said adjustment sleeve.

* * * * *

UNITED STATES PATENT AND TRADEMARK OFFICE

CERTIFICATE OF CORRECTION

PATENT NO. : 5,802,670

DATED : September 8, 1998

INVENTOR(S) : Volker BIENEK

It is certified that error appears in the above-identified patent and that said Letters Patent is hereby corrected as shown below:

In column 5, line 5, after 'Ser. No.', delete "08/735/970," and insert --08/735,970,--.

In column 9, line 2, Claim 1, before 'connected', delete "adjustable" and insert --adjustably--.

Signed and Sealed this

Twenty-third Day of February, 1999

*Attest:*

Q. TODD DICKINSON

*Attesting Officer*

*Acting Commissioner of Patents and Trademarks*